US007894766B2

(12) United States Patent
Tsuchiya

(10) Patent No.: US 7,894,766 B2
(45) Date of Patent: Feb. 22, 2011

(54) BOOKBINDING SYSTEM AND BOOKBINDING METHOD

(75) Inventor: Tsuyoshi Tsuchiya, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 593 days.

(21) Appl. No.: 11/730,627

(22) Filed: Apr. 3, 2007

(65) Prior Publication Data

US 2008/0095562 A1 Apr. 24, 2008

(30) Foreign Application Priority Data

Oct. 12, 2006 (JP) ..... 2006-278549

(51) Int. Cl.
*G03G 15/00* (2006.01)

(52) U.S. Cl. ..... 399/409; 399/408

(58) Field of Classification Search ..... 399/409, 399/408

See application file for complete search history.

(56) References Cited

U.S. PATENT DOCUMENTS 5,531,429 A * 7/1996 Clark ..... 270/58.11
5,833,423 A * 11/1998 Yamaguchi et al. ..... 412/8
6,698,743 B2 * 3/2004 Kuramoto et al. ..... 270/58.08
7,263,328 B2 * 8/2007 Asai et al. ..... 399/408
7,584,949 B2 * 9/2009 Kaneko et al. ..... 270/58.12
2006/0159480 A1 * 7/2006 Mima et al. ..... 399/82

FOREIGN PATENT DOCUMENTS

JP 2002-162867 6/2002
JP 2004-209870 7/2004

OTHER PUBLICATIONS

Japanese Office Action dated Oct. 21, 2008.

* cited by examiner

*Primary Examiner*—Anthony H. Nguyen
(74) *Attorney, Agent, or Firm*—Finnegan, Henderson, Farabow, Garrett & Dunner, L.L.P.

(57) ABSTRACT

A bookbinding system that pastes a cover sheet on a sheet bundle, the bookbinding system includes: an image forming section which forms a toner image based on image data; a sheet storing section which stacks recording sheets on which toner images have been recorded by the image forming section, aligns the recording sheets thereby forming a sheet bundle; a heating member which applies heat to an adhesive to melt; a cover sheet pasting section which pastes a spine of the sheet bundle and a cover sheet with the adhesive melted by the heating member; and a controller which controls the image forming section. The controller controls the image forming section not to record the toner image based on the image data in the vicinity of an edge portion on a side of the spine of each of the recording sheets that constitute the sheet bundle.

12 Claims, 10 Drawing Sheets

BOOKBINDING SYSTEM AND BOOKBINDING METHOD

This application is based on Japanese Patent Application No. 2006-278549 filed on Oct. 12, 2006, which are hereby incorporated by reference.

BACKGROUND OF THE INVENTION

The present invention relates to a bookbinding system and a bookbinding method for covering a sheet bundle with a cover sheet and forming a booklet.

An electrophotographic image forming apparatus has a high-speed performance, a multi-function, and a network function and is connected to a large capacity sheet feeding device and a large capacity stacker, thus finds wide applications as a printing press.

Further, as a bookbinding process, a one for covering one sheet bundle composed of stacked printed sheets with a cover sheet in a U-shape and forming a booklet is known.

When using the image forming apparatus as a printing press, a bookbinding apparatus for bookbinding printed papers is connected to it, thus the processing from printing to bookbinding can be performed by one system in a flowing sequence.

The bookbinding apparatus described in Unexamined Japanese Patent Application Publication No. 2004-209870 is connected to the image forming apparatus for use. In this bookbinding apparatus, the adhesive reservoir and roller move back and forth on the bottom side of the sheet bundle integrally with each other, thereby coat an adhesive on the spine of the sheet bundle. The adhesive feeding unit for feeding a granular adhesive holds the sheet bundle at the standby position of the adhesive reservoir and puts a predetermined amount of the granular adhesive into the adhesive reservoir at the opposite position.

In Unexamined Japanese Patent Application Publication No. 2004-209870, the description does not take the adhesive strength of the adhesive coated on the spine of the sheet bundle into sufficient account.

When bookbinding by coating a heated adhesive on the spine of a sheet bundle and pasting a cover sheet thereon, if a toner image is formed as far as the end of each sheet in the neighborhood of the spine of the sheet bundle, by the heat of the adhesive heated at time of coating the adhesive, the toner image is heated and rises in temperature.

The heated toner image is pasted to the neighboring sheet and tacking is apt to occur. When the tacking occurs, the sheets are hardly separated from each other, and the spread amount of each page is reduced, thus the contents described on the page are almost unreadable. Therefore, when the pages are spread forcibly and the sheets are separated from each other, the sheets are broken, and the image is damaged, thus there is the possibility that the bookbinding quality may be impaired.

When sheets with a toner image formed on one side thereof are stacked on top of each other, the heated toner image is closely adhered to the opposite sheet surface, causing pasting of the sheets.

When sheets with a toner image formed on both sides thereof are stacked on top of each other, the toner image heated on either sheet and the toner image heated on another opposite sheet are adhered closely to each other, causing pasting of the sheets.

SUMMARY OF THE INVENTION

An aspect of the present invention is as indicated below.

1. A bookbinding system for pasting a cover sheet onto a sheet bundle, comprising: an image forming section for forming a toner image on the basis of image data; a sheet storing section for stacking and aligning recording sheets on which a toner image is recorded by the image forming section, thereby forming a sheet bundle; a heating member for heating and melting an adhesive; a cover sheet pasting section for pasting the spine of the sheet bundle and the cover sheet with the adhesive melted by the heating member; and a controller for controlling the image forming section, wherein the controller controls the image forming section so as not to record the toner image based on the image data in the vicinity of the end of the recording sheets composing the sheet bundle on the spine side.

2. A bookbinding method for pasting a cover sheet onto a sheet bundle, comprising: an image forming step of forming an image on recording sheets composing the sheet bundle so as not to record an image in the neighboring area of the end of the sheet bundle on the spine side but so as to record a toner image based on image data in the other area; a stacking step of stacking and aligning a plurality of recording sheets with a toner image recorded and forming a sheet bundle; and a pasting step of pasting the spine of the sheet bundle and cover sheet with heated and melted adhesive.

DETAILED DESCRIPTION OF THE PREFERRED EMBODIMENT

The embodiment of the bookbinding apparatus of the present invention and the image forming apparatus having the bookbinding apparatus will be explained with reference to the accompanying drawings, though the present invention is not limited to the concerned embodiment.

Figure 1:
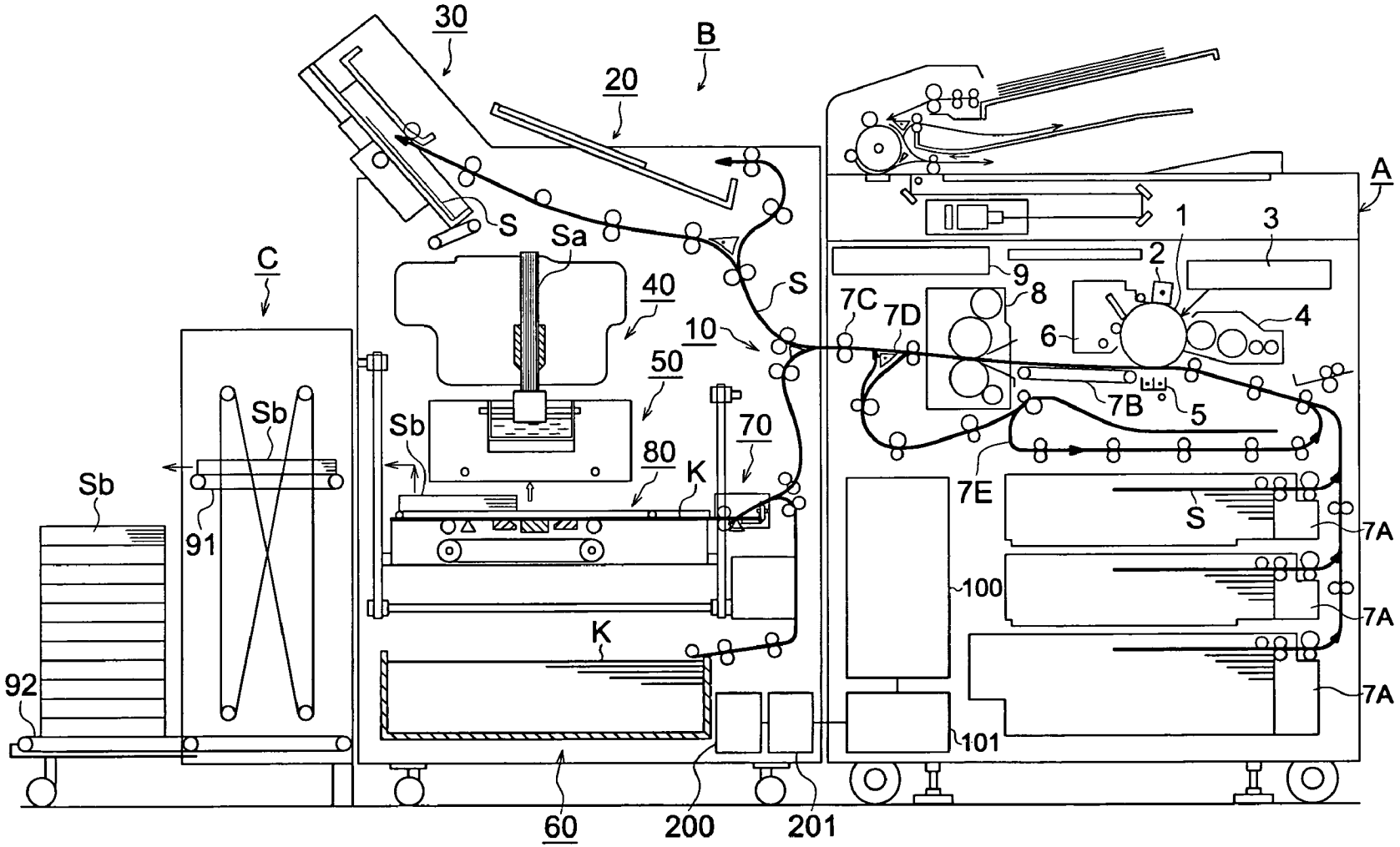
FIG. 1 is a whole block diagram of the image forming apparatus having the image forming apparatus main body, bookbinding apparatus, and booklet storing apparatus.

FIG. 1 is a whole block diagram of the bookbinding system having an image forming apparatus main body A, a bookbinding apparatus (finisher) B, and a booklet storing apparatus C.

[Image Forming Apparatus Main Body A]

The image forming apparatus main body A has an image forming section composed of a charger 2, an imagewise exposure unit 3, a developing unit 4, a transfer and discharging unit 5, and a cleaning unit 6 which are arranged around a rotary image carrier 1. The image forming section charges uniformly the surface of the image carrier 1 by the charger 2, then performs exposure scanning based on image data read from a document by a laser beam of the imagewise exposure unit 3 to form a latent image, reversely develops the latent image by the developing unit 4, thereby forms a toner image on the surface of the image carrier 1.

A recording sheet S (hereinafter, referred to as a sheet) which is a sheet fed from a sheet storing unit 7A is sent to a transfer position. At the transfer position, the toner image is transferred onto the sheet S by the transfer and discharging unit 5, and then the sheet S is discharged and separated from the image carrier 1, is conveyed by a conveying section 7B, is heated and fixed continuously by a fixing unit 8, and is ejected to sheet ejection rollers 7C.

When forming an image on both sides of the sheet S, the sheet S heated and fixed by the fixing unit 8 is branched off from the ordinary path by a conveyance path switching member 7D, is switched back by a reverse and conveyance section 7E to be turned upside down, then passes again through the image forming section, is formed an image on the back thereof, and is ejected outside the apparatus from the sheet ejection rollers 7C via the fixing unit 8. The sheet S ejected from the sheet ejection rollers 7C is sent to the bookbinding apparatus B.

From the surface of the image carrier 1 after the image processing, a developer remaining thereon is removed by the cleaning unit 6 and it prepares for the next image formation.

On the upper part of the image forming apparatus main body A, an operation section 9 having an input member and a display member is arranged.

[Bookbinding Apparatus B]

As shown in FIG. 1, the bookbinding apparatus B relating to the present invention has a sheet conveying section 10, a sheet ejection section 20, a sheet storing section 30, a sheet bundle conveying section 40, an adhesive coating section 50, a cover sheet feeding section 60, a cover sheet cutting section 70, and a cover sheet pasting section 80. These sections are arranged in a column almost in the vertical direction.

Figure 2:
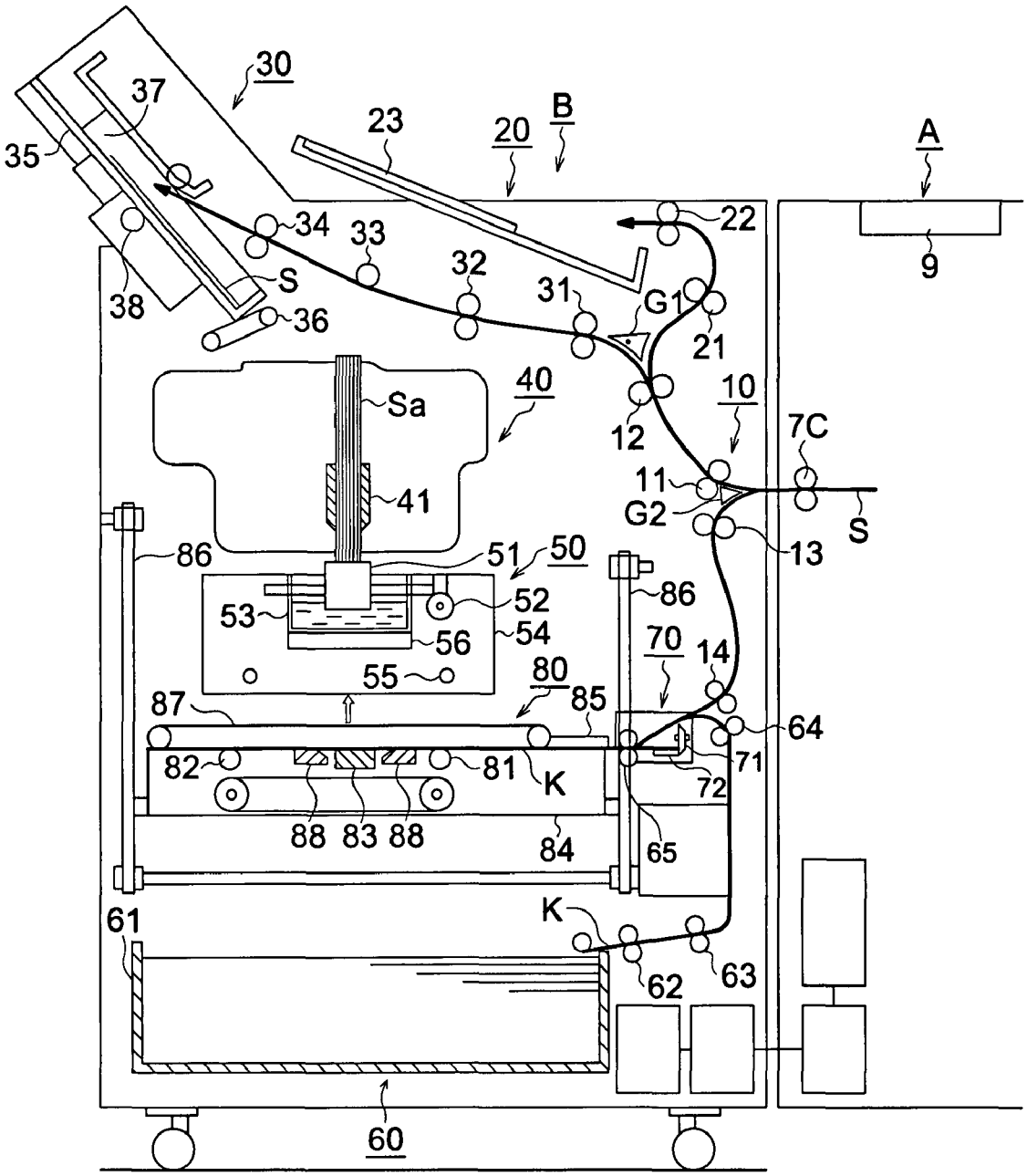
FIG. 2 is a cross sectional view of the bookbinding apparatus relating to the present invention.

FIG. 2 is a cross sectional view of the bookbinding apparatus B relating to the present invention.

<Sheet Conveying Section 10>

The sheet S introduced into the sheet conveying section 10 is held and conveyed by conveying rollers 11 and 12 and is branched to either of the sheet ejection section 20 and the sheet storing section 30 by a conveyance path switching member G1.

A conveyance path switching member G2 arranged on the upstream side of the conveying rollers 11 in the sheet conveying direction branches the sheet ejected from the image forming apparatus main body A to either of the conveyance path of the conveying rollers 11 and the conveyance path of conveying rollers 13. The sheet S conveyed to the conveyance path of the conveying rollers 13 is held by conveying rollers 14 and is sent to the cover sheet pasting section 80.

<Sheet Ejection Section 20>

When this sheet conveyance is set, the conveyance path switching member G1 blocks the conveyance path to the sheet bundle conveying section 40 and releases the conveyance path to the sheet ejection section 20.

The sheet S passing the conveyance path of the sheet ejection section 20 is held and conveyed upward by conveying rollers 21 and is ejected and stored on a fixed sheet ejection tray 23 on the uppermost part of the apparatus by conveying rollers 22. The fixed sheet ejection tray 23 directly receives sheets S ejected from the image forming apparatus main body A and can stack up to 200 sheets.

<Sheet Storing Section 30>

The sheet S branched to the left drawn on the downstream side in the sheet conveying direction by the conveyance path switching member G1 is held by conveying rollers 31, 32, 33, and 34, is stored at a predetermined position of the sheet storing section 30, and is stacked sequentially, thus a sheet bundle Sa composed of sheets S of a predetermined number is formed. The sheet storing section 30 has a sheet loading table 35 arranged with a gradient, a movable sheet trailing edge positioning member 36, a sheet width aligning member 37, and a sheet bundle conveying roller 38.

<Sheet Bundle Conveying Section 40>

The sheet S stacked on the sheet loading table 35 of the sheet storing section 30 is conveyed obliquely downward by a push-out member not drawn. Thereafter, the sheet S is held by a holding member 41 of the sheet bundle conveying section 40 and the holding member 41 swings so as to turn down the surface (spine) of the sheet bundle Sa to be coated with an adhesive in the state that the sheet bundle Sa is kept held and stops at a predetermined position.

<Adhesive Coating Section 50>

The adhesive coating section 50 has an adhesive coating member (may be referred to as a coating roller) 51, a drive member 52 for driving the coating roller 51 to rotate, an adhesive container 53 for storing adhesive, a moving section 54 for supporting the adhesive container 53 and moving from the initial position of the bookbinding apparatus B on the back side to the adhesive coating position on the front side thereof, a moving member 55 for moving back and forth the moving section 54, and a heating member 56 stored in the adhesive container 53 for heating an adhesive N.

<Cover Sheet Feeding Section 60>

A cover sheet K stored in a cover sheet stacking member 61 of the cover sheet feeding section 60 is separated and fed by a sheet feeding member 62, is held by conveying rollers 63, 64, and 65, and is conveyed to the cover sheet pasting section 80.

<Cover Sheet Cutting Section 70>

The cover sheet cutting section 70 integrally structured above the cover sheet feeding section 60 shown in the drawing and on the right of the cover sheet pasting section 80, shown in the drawing which will be described later, cuts the cover sheet K in a predetermined length in the conveying direction by a rotary cutter composed of a rotary blade 71 and a fixed blade 72.

The predetermined length is a length obtained by adding the length of the spine of the sheet bundle Sa to the length of two sheets S in the moving direction. For example, when performing the wrapping bookbinding process by pasting the cover sheet K on the spine of the sheet bundle Sa composed of sheets S of size A4, assuming the maximum number of sheets of the sheet bundle Sa as about 300 and the thickness thereof as about 30 mm, the predetermined length is set to 450 mm obtained by adding the thickness about 30 mm of the sheet bundle Sa to two times of the length 210 mm of the short side, of the sheets of size A4 and the end portion of the cover sheet K is cut. As a total length of the cover sheet K before cutting, a wide size of 450 mm or more is used.

Also when performing the wrapping bookbinding process for sheets S of size A5, size B5, and size of 8.5×11 inches (one inch is 25.4 mm) and preparing booklets Sb, a predetermined length is set from the length of the short side of the sheets and the thickness of the sheet bundle.

In the operation section 9 of the image forming apparatus main body A, when the sheet size, the number of sheets, and the sheet thickness are selected and set or detected, the controller sets a predetermined cut length of the cover sheet K. The length of the cover sheet K before cutting is decided beforehand in accordance with the maximum number of sheets and is stored in the cover sheet stacking member 61 of the cover sheet feeding section 60.

<Cover Sheet Pasting Section 80>

The cover sheet pasting section 80 has conveying rollers 81 and 82 for receiving and conveying the cover sheet K fed from the cover sheet feeding section 60 and stopping it at a predetermined position, a pressurizing member 83 for allowing the cover sheet K to exert pressure on the adhesive coating surface of the sheet bundle Sa, a moving frame 84 for supporting the conveying rollers 81 and 82 and pressurizing member 83, an aligning member 85, and a rise-and-fall section 86 for moving the moving frame 84 in the vertical direction.

When the cover sheet pasting section 80 stops at the descending position and introduces the cover sheet K, the aligning section 85 moves from the initial position according to the size of the cover sheet K and presses both sides of the cover sheet K in the width direction before cutting to align the width. The cover sheet K aligned in width and corrected in bending is switched back in the opposite direction of the introduction, is conveyed to the cover sheet cutting section 70, and is cut at a predetermined position.

Further, before the cover sheet pasting section 80 adheres and joins the cover sheet K after cutting to the spine of the sheet bundle Sa at the descending position, the aligning section 85 moves again from the initial position, presses both sides of the cover sheet K in the width direction, aligns the width, and fixes the cover sheet K at a predetermined position. Thereafter, the aligning section 85 returns to the initial position so as not to impede the junction between the cover sheet K and the sheet bundle Sa and continuously the cover sheet pasting section 80 moves up. At time of moving up, the cover sheet K is supported at a predetermined position.

Therefore, the aligning section 85 installed in the cover sheet pasting section 80 capable of moving up and down positions the cover sheet K before and after cutting by the cover sheet cutting section 70 in the direction of the cover sheet width, thus improvement of the cover sheet cutting accuracy, improvement of the positioning accuracy between the sheet bundle Sa and the cover sheet K, and simplification of the structure can be realized.

The rise-and-fall section 86 rotates the left and right belts, thereby moves the moving frame 84 to the upper position. At this rising position, the pressurizing member 83 exerts pressure on the cover sheet K at the center loaded on thereof and the adhesive coating surface of the sheet bundle Sa is adhered on the cover sheet K. After end of the adhesive coating process onto the sheet bundle Sa, the adhesive coating section 50 moves and retreats backward.

<Cover Sheet Bending Process>

On the upper part of the cover sheet pasting section 80, a cover sheet bending section is mounted. The cover sheet bending section has a pair of molding members 88 which are symmetrical right and left. The molding members 88 can touch and separate in the thickness direction of the sheet bundle Sa. The molding members 88 bend the cover sheet K along the side edge of the adhesive coating surface of the sheet bundle Sa and stack a front cover sheet and a back cover sheet on the front and back of the sheet bundle Sa.

After end of the cover sheet K bending step, the cover sheet pasting section 80 moves down and retreats by a predetermined amount by the descending drive of the rise-and-fall section 86 and then an ejection belt 87 moves to the lower position of the booklet Sb, that is, from the position equivalent to the outside of the booklet Sb in the width direction perpendicular to the conveying direction of the booklet Sb to the position equivalent to the inside and then stops. Thereafter, when the holding by the holding member 41 is released, the booklet Sb moves down and stops at the position where the lower spine of the booklet Sb comes into contact with the top of the ejection belt 87.

The booklet Sb that the cover sheet K is pasted on the spine (the opposite side of the edge portion) of the sheet bundle Sa with an adhesive coated, thus the front cover sheet and back cover sheet are formed is ejected into the booklet storing device C outside the apparatus by the ejection belt 87 arranged on the upper part of the aligning member 85.

[Booklet Storing Device C]

The booklet Sb ejected by the ejection belt 87 is loaded on a vertically-movable conveying belt 91 of the booklet storing device C shown in FIG. 1, is sequentially ejected by the rotation of the conveying belt 91, and is stacked on a sheet ejection table 92.

[Preparing Step of with-Cover Sheet Bookbinding]

<Conveyance of Sheet Bundle and Cover Sheet>

Figure 3:
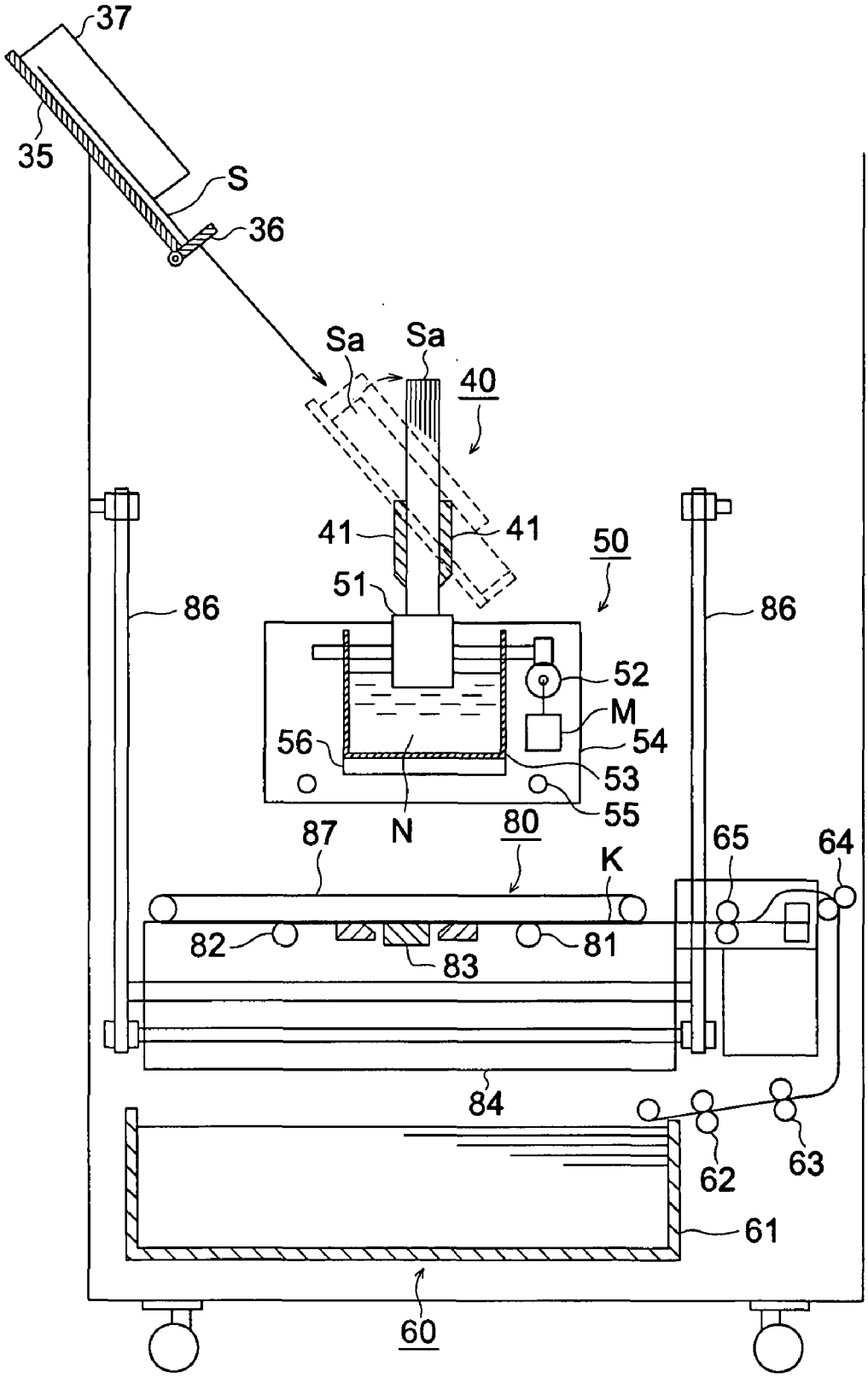
FIG. 3 is a cross sectional view of the sheet bundle conveying section and adhesive coating section.

FIG. 3 is a cross sectional view of the sheet bundle conveying section 40 and adhesive coating section 50.

The sheets S loaded and aligned on the sheet loading table 35 of the sheet storing section 30 are held by the holding member 41. The sheet trailing edge positioning member 36 is rotated by a drive member not drawn and retreats under the sheet loading table 35. The holding member 41 holding the sheet bundle Sa moves obliquely downward as shown by the dashed line in the drawing, then rotates, turns down the surface of the sheet bundle Sa to be coated with an adhesive, is held in the upright state, and stops at a predetermined position.

On the other hand, the sheets K stored in the cover sheet stacking member 61 of the cover sheet feeding section 60 are separated and fed by the sheet feeding member 62, are held by the conveying rollers 63, 64, and 65, are conveyed by the conveying rollers 81 and 82 of the cover sheet pasting section 80, and are stopped at the predetermined position.

The cover sheet cutting section 70 arranged on the right of the conveying rollers 65 shown in the drawing cuts the cover sheet K in a predetermined length in the conveying direction. Namely, the length of the cover sheet K in the conveying direction varies with the sheet size and thickness of the sheet bundle Sa, so that the sheet size, the number of sheets S, and the thickness of the sheets S are inputted or detected beforehand, thus the wrapping length of the cover sheet K is calculated, and before pasting the cover sheet, the surplus part of the cover sheet K is cut to an optimum length by the cover sheet cutting section 70.

<Adhesive Coating on Sheet Bundle>

The moving section 54 of the adhesive coating section 50 is moved by a drive member not drawn in the direction parallel with the bottom of the sheet bundle Sa held in the upright state by the holding member 41 in the longitudinal direction.

The moving section 54 starts movement from the initial position on the back side of the bookbinding apparatus B, moves along the moving member 55, stops at the predetermined position on the front side of the bookbinding apparatus B, then is driven to reverse, and returns to the initial position.

Figure 4:
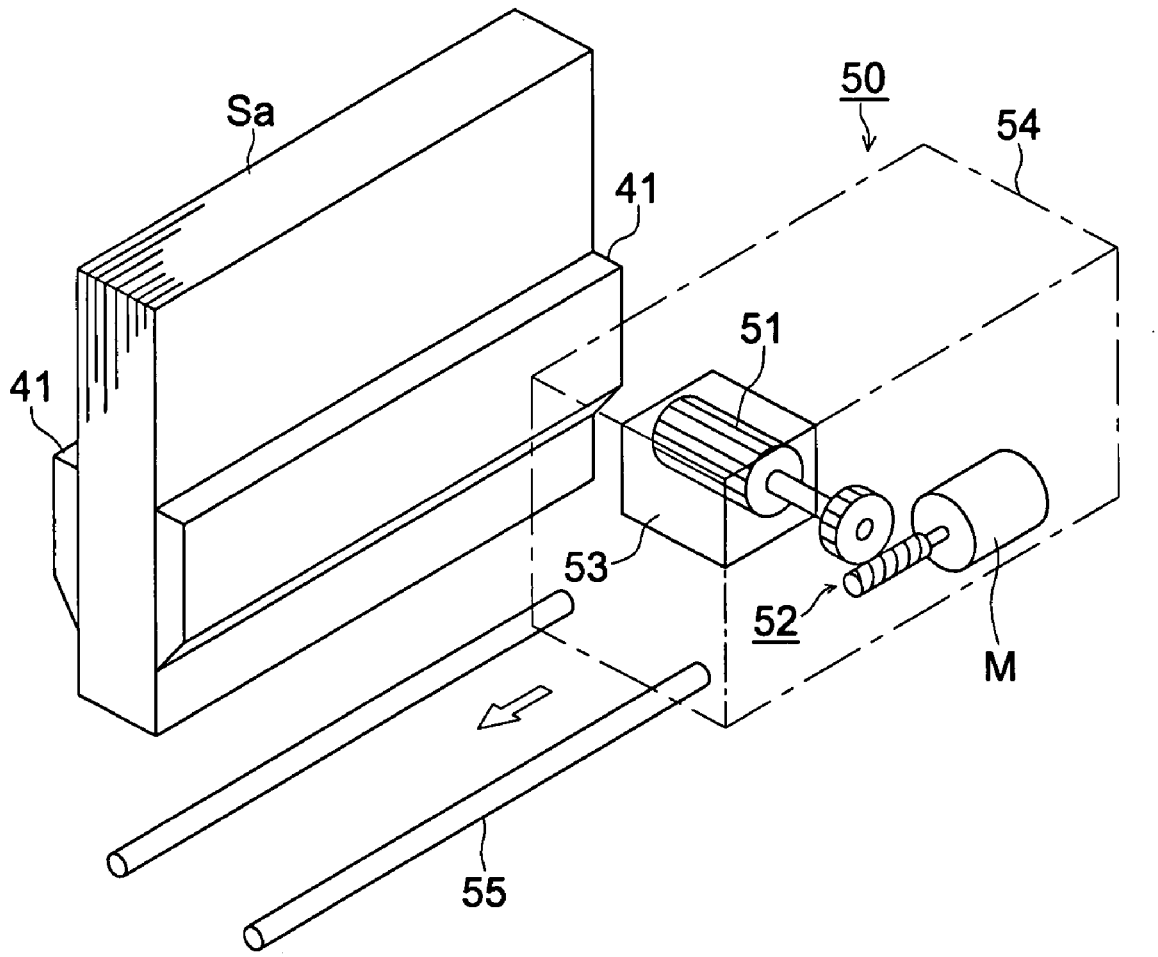
FIG. 4 is a perspective view of the adhesive coating section and holding member.

FIG. 4 is a perspective view of the adhesive coating section 50 and holding member 41.

By a motor M and the drive member 52, the coating roller 51 immersed in the adhesive container 53 storing the adhesive (paste) N is rotated. By the forward movement or forward and backward movement of the moving section 54, the coating roller 51 coats the adhesive N on the bottom of the sheet bundle Sa held in the upright state in the longitudinal direction.

<Adhesion of Sheet Bundle and Cover Sheet>

Figure 5:
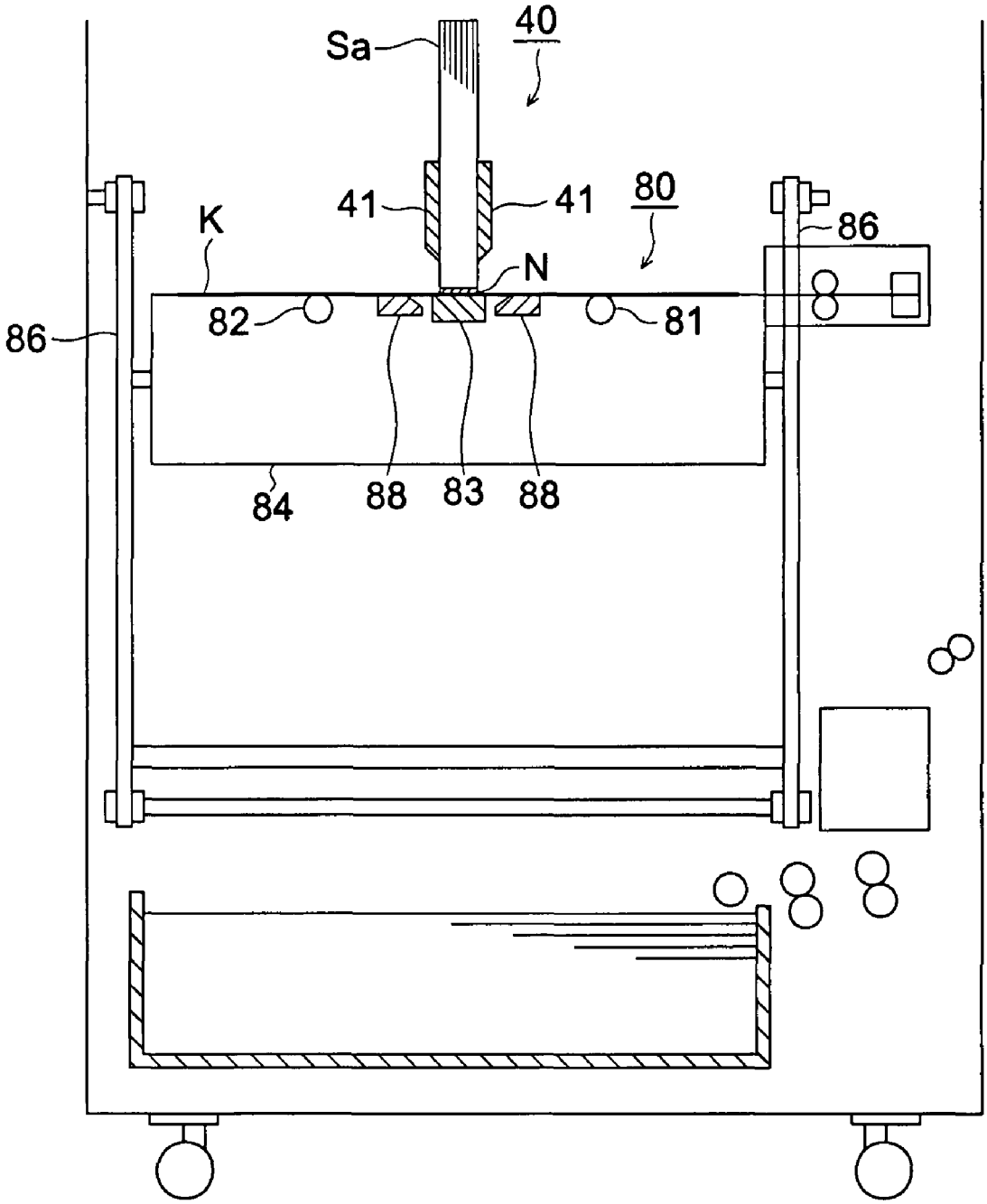
FIG. 5 is a cross sectional view of the sheet bundle conveying section and cover sheet pasting section when adhering the sheet bundle and cover sheet.

FIG. 5 is a cross sectional view of the sheet bundle conveying section 40 and cover sheet pasting section 80 when adhering the sheet bundle Sa and cover sheet K.

After end of the adhesive coating step onto the sheet bundle Sa, a drive member (not drawn) causes the rise-and fall section 86 to move the moving frame 84 to the predetermined position at which it rises. At this rising position, the pressurizing member 83 exerts pressure on the cover sheet K at the center loaded on thereof and the adhesive coating surface of the sheet bundle Sa is adhered on the cover sheet K.

<Cover Sheet Bending>

Figure 6:
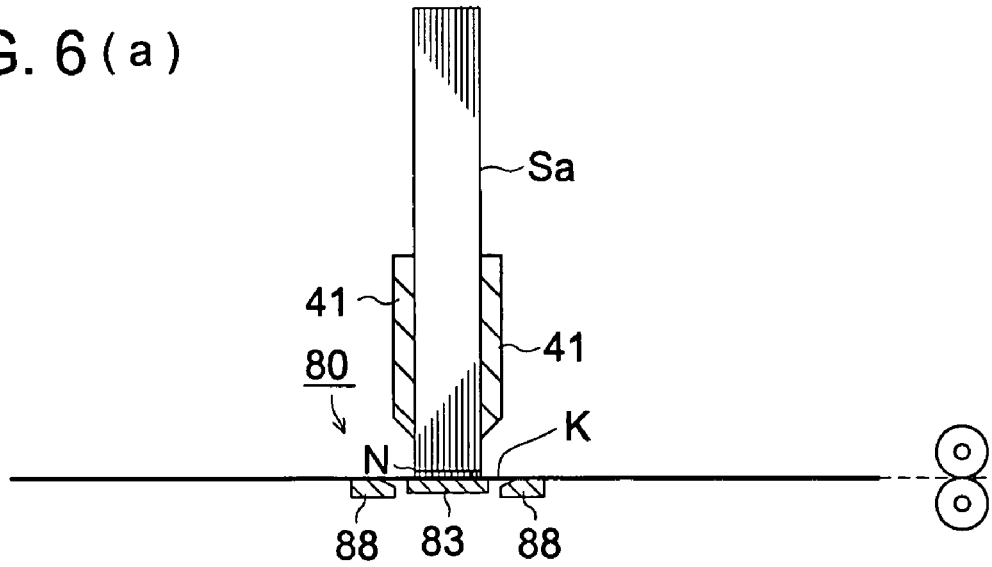
FIGS. 6(*a*) to 6(*d*) are cross sectional views of the cover sheet pasting section and sheet bundle showing the cover sheet bending step.
Figure 6:
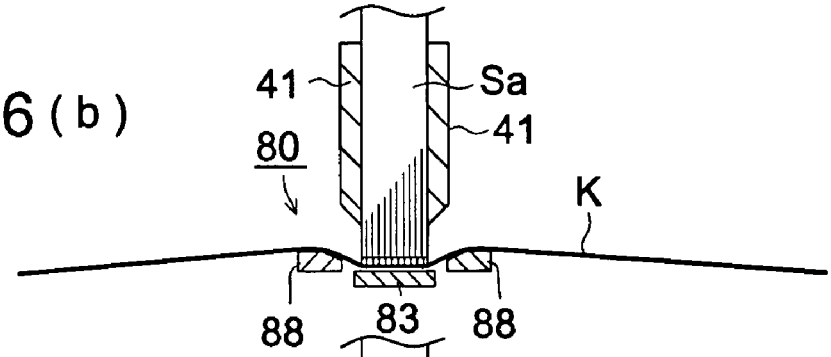
Figure 6:
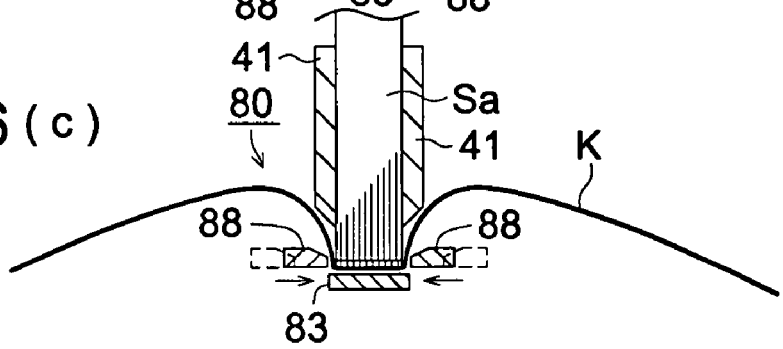
Figure 6:
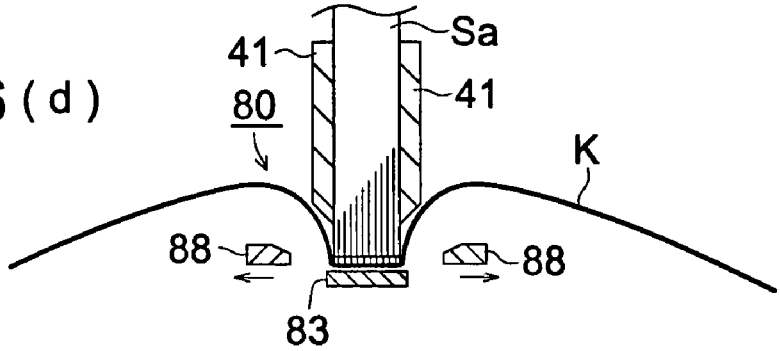

FIGS. 6(*a*) to 6(*d*) are cross sectional views of the cover sheet pasting section 80 and sheet bundle Sa showing the cover sheet K bending step. FIG. 6(*a*) shows the status at start time of cover sheet bending, FIG. 6(*b*) the status at intermediate time of cover sheet bending, FIG. 6(*c*) the status at end time of cover sheet bending, and FIG. 6(*d*) the status at time of releasing the pressurization of cover sheet bending.

Figure 7:
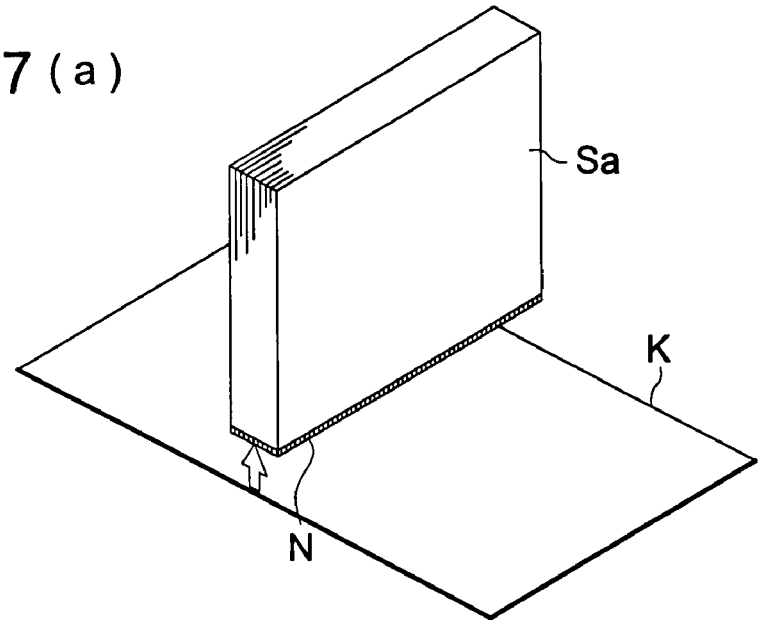
FIGS. 7(*a*) to 7(*c*) are perspective views showing the booklet preparation process by the sheet bundle and cover sheet.
Figure 7:
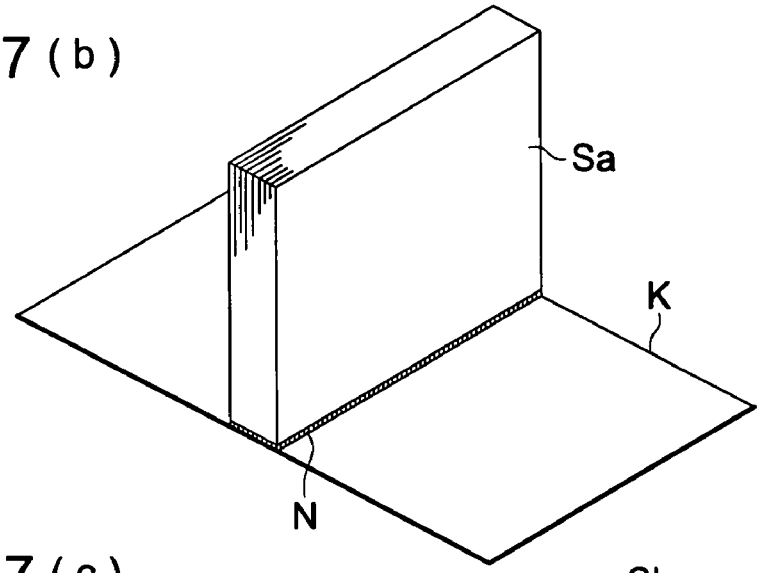
Figure 7:
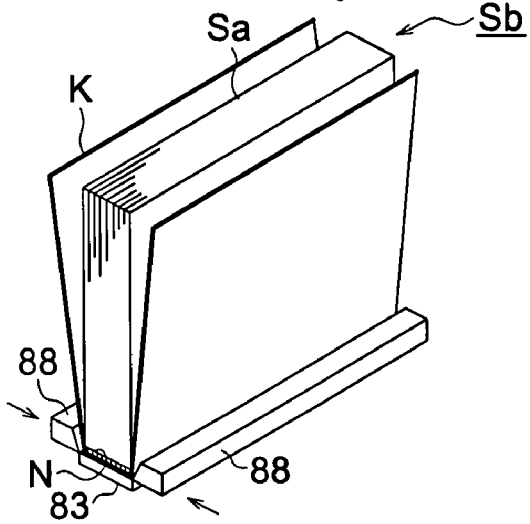

FIGS. 7(*a*) to 7(*c*) are perspective views showing the preparation process of the booklet Sb prepared by the sheet bundle Sa and cover sheet K. FIG. 7(*a*) is a perspective view of the cover sheet K and sheet bundle Sa in the state before the cover sheet pasting process, and FIG. 7(*b*) is a perspective view of the sheet bundle Sa pasted with the cover sheet K, and FIG. 7(*c*) is a perspective view of the booklet Sb prepared by wrapping-bending the cover sheet K over the sheet bundle Sa.

In the rising state of the cover sheet pasting section 80 shown in FIGS. 7(*a*) to 7(*c*) after adhering the cover sheet K to the sheet bundle Sa with the adhesive N pasted, the pair of molding members 88 is driven by a drive member not drawn. The holding member 41 holding the sheet bundle Sa moves down. As the sheet bundle Sa moves down, the cover sheet K moves down held by the pair of molding member 88, and is curved starting from the side edge of the adhesive coated surface of the sheet bundle Sa (refer to FIG. 6(*b*)).

Thereafter, the pair of molding members 88 moves horizontally toward the adhesive coated surface side of the sheet bundle Sa, presses and reforms both side surfaces of the sheet bundle Sa, thereby forms the booklet Sb.

<Document Toner Image and Non-Image Area>

The imagewise exposure unit 3 of the image forming section of the image forming apparatus main body A shown in FIG. 1 forms a latent image of a document image based on the document data on the surface of the image carrier 1.

The latent image of the document image formed by the imagewise exposure unit 3 is visualized by the developing unit 4 and becomes a document toner image T1 on the image carrier 1. The document toner image T1 is transferred onto the sheet S by the transfer and discharging unit 5 and then is separated from the image carrier 1 for the reason that the electric charge on the sheet S surface has been eliminated.

The sheet S with the document toner image T1 formed on one side thereof or the sheet S with the document toner image T1 formed on both sides thereof is heated and fixed by the fixing unit 8 and is sent to the bookbinding apparatus B.

A plurality of sheets S sequentially conveyed into the bookbinding apparatus B are stacked and aligned on the sheet storing section 30, thus the sheet bundle Sa is formed and then is coated with the heated adhesive N, and the cover sheet K is pasted on the spine of the sheet bundle Sa.

Figure 8:
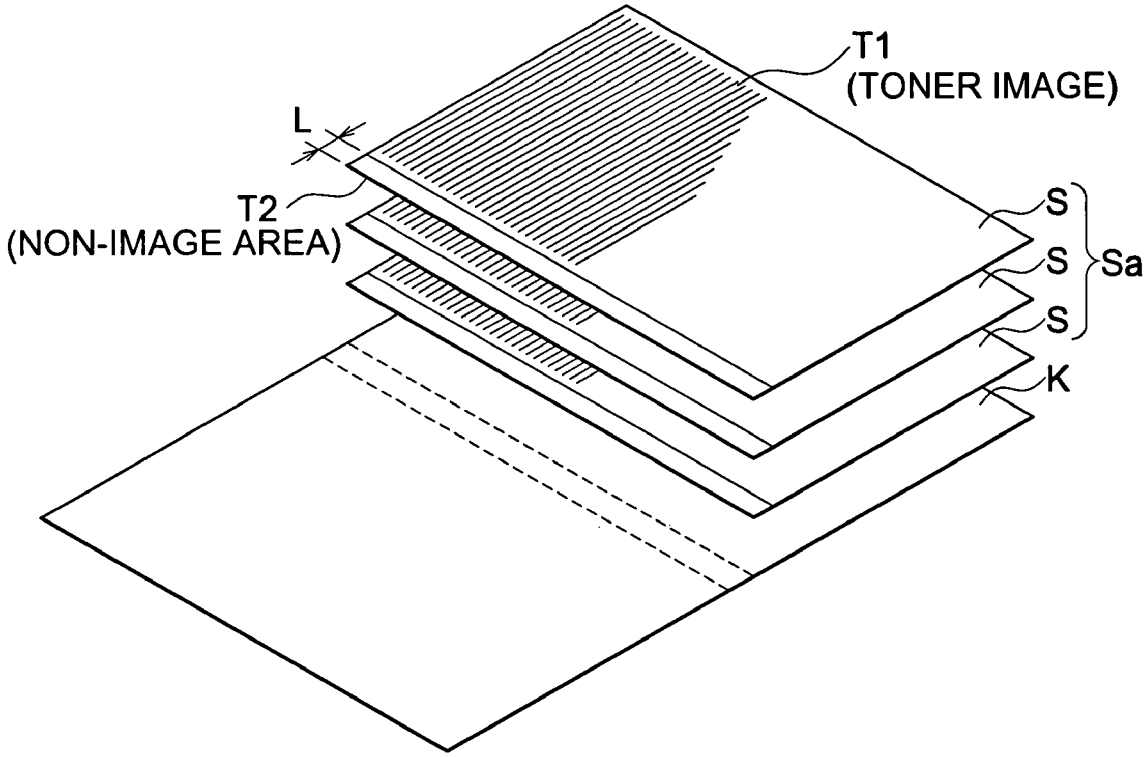
FIG. 8 is a perspective view showing the state of the sheet bundle composed of a plurality of sheets and cover sheet before adhesion.

FIG. 8 is a perspective view showing the state of the sheet bundle Sa composed of a plurality of sheets S and cover sheet K before adhesion.

A main controller 100 for controlling the image forming section controls so as to form the latent image of the document image by the imagewise exposure unit 3 as well as so as to provide a non-image area T2 so that the controller 100 controls the image forming section to provide the non-image area T2 that does not form the document toner image T1 based on the document data at the end of sheet S and to form latent image of the document image using the imagewise exposure unit 3. The document toner image T1 based on the document data in the neighborhood of the end of the sheet S with the adhesive N coated by the adhesive coating section 50.

The non-image area T2 has a length of 2 to 5 mm from the end face of the sheet S where the adhesive is coated.

Further, the main controller 100 for controlling the image forming section shifts and forms the document toner image T1 based on the document data to the other end side opposite to the end of the sheet S with the adhesive N coated by the adhesive coating section 50 so that the controller 100 controls the image forming section to provide the non-image area T2 that does not form the document toner image T1 based on the document data at the end of sheet S and to form latent image of the document image using the imagewise exposure unit 3.

Or, the main controller 100 for controlling the image forming section shifts and forms the document toner image T1 based on the document data to the other end side opposite to the end of the sheet S with the adhesive N coated by the adhesive coating section 50 as well as controls the image forming section to reduce document toner images, to provide the non-image area T2, and to form the latent image of the document image using the imagewise exposure unit 3 in accordance with the shift amount of the document toner image T1.

Or, the main controller 100 controls the image forming section no to form an image at the end of the sheet S with the adhesive N coated by the adhesive coating section 50 and to form the latent image of the document image using the imagewise exposure unit 3 among the document toner images T1 based on the document data. When the document toner image T1 is a character image, the main controller 100 changes the character setting so as to reduce the number of characters on one line and controls so as to provide the non-image area T2.

Figure 9:
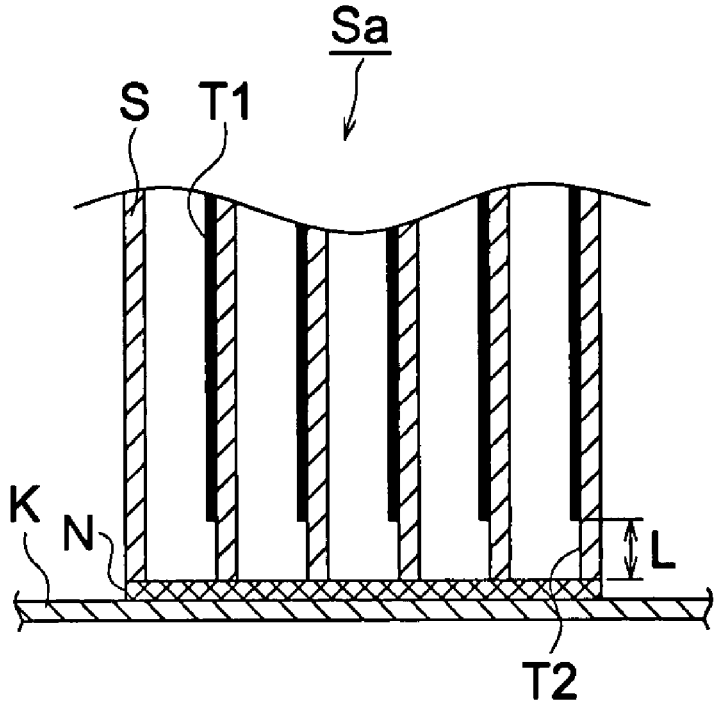
FIGS. 9(*a*) and 9(*b*) are schematic views showing the state of the sheet bundle composed of a plurality of sheets and cover sheet after adhesion.
Figure 9:
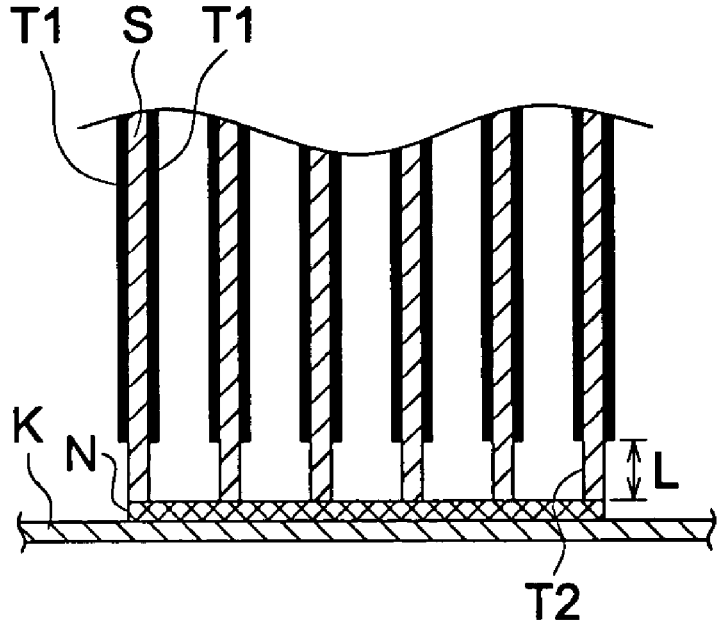

FIGS. 9(*a*) and 9(*b*) are schematic views showing the state of the sheet bundle Sa composed of a plurality of sheets S and cover sheet K after adhesion. FIG. 9(*a*) shows the state that sheets S with the document toner image T1 formed on one side thereof are stacked on top of each other, and FIG. 9(*b*) shows the state that sheets S with the document toner image T1 formed on both sides thereof are stacked on top of each other.

Figure 10:
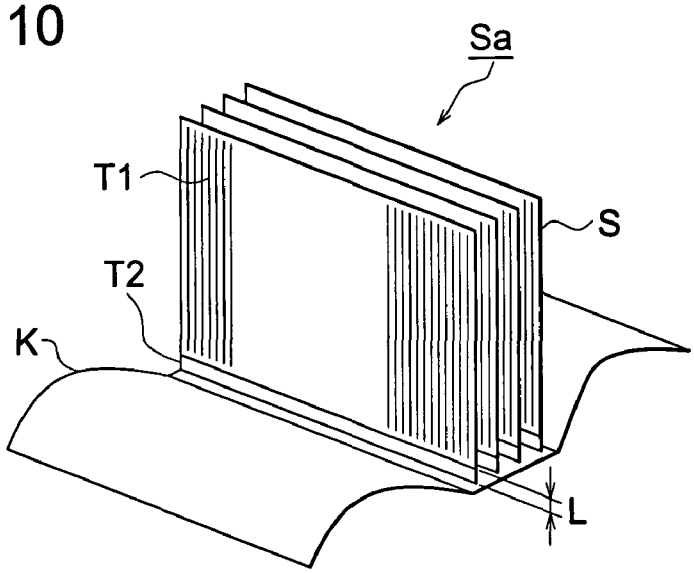
FIG. 10 is a perspective view showing the state of the sheet bundle composed of a plurality of sheets and cover sheet after adhesion.

FIG. 10 is a perspective view showing the state of the sheet bundle Sa composed of a plurality of sheets S and cover sheet K after adhesion.

The non-image area T2 having a length L from the end face of the sheet S where the adhesive N is coated is provided, thus a space area of the length L is formed between the adhesive N and the end of the document toner image T1, so that the heat of the heated adhesive N is not transferred to the end of the document toner image T1 and the document toner image T1 is prevented from temperature rise.

As shown in FIG. 9(*a*), the document toner image T1 is prevented from temperature rise, so that when sheets S with the document toner image T1 formed on one side thereof are stacked on top of each other, the document toner image T1 and sheets S are prevented from pasting.

As shown in FIG. 9(*b*), the document toner image T1 is prevented from temperature rise, so that when sheets S with the document toner image T1 formed on both sides thereof are stacked on top of each other, the document toner images T1 are prevented from pasting.

Further, when performing the wrapping bookbinding process for specific sheets such as coated sheets, glossy sheets, and thick sheets, these specific sheets are set the operation section 9 and for the selected specific sheet, the length L of the non-image area T2 may be changed.

Figure 11:
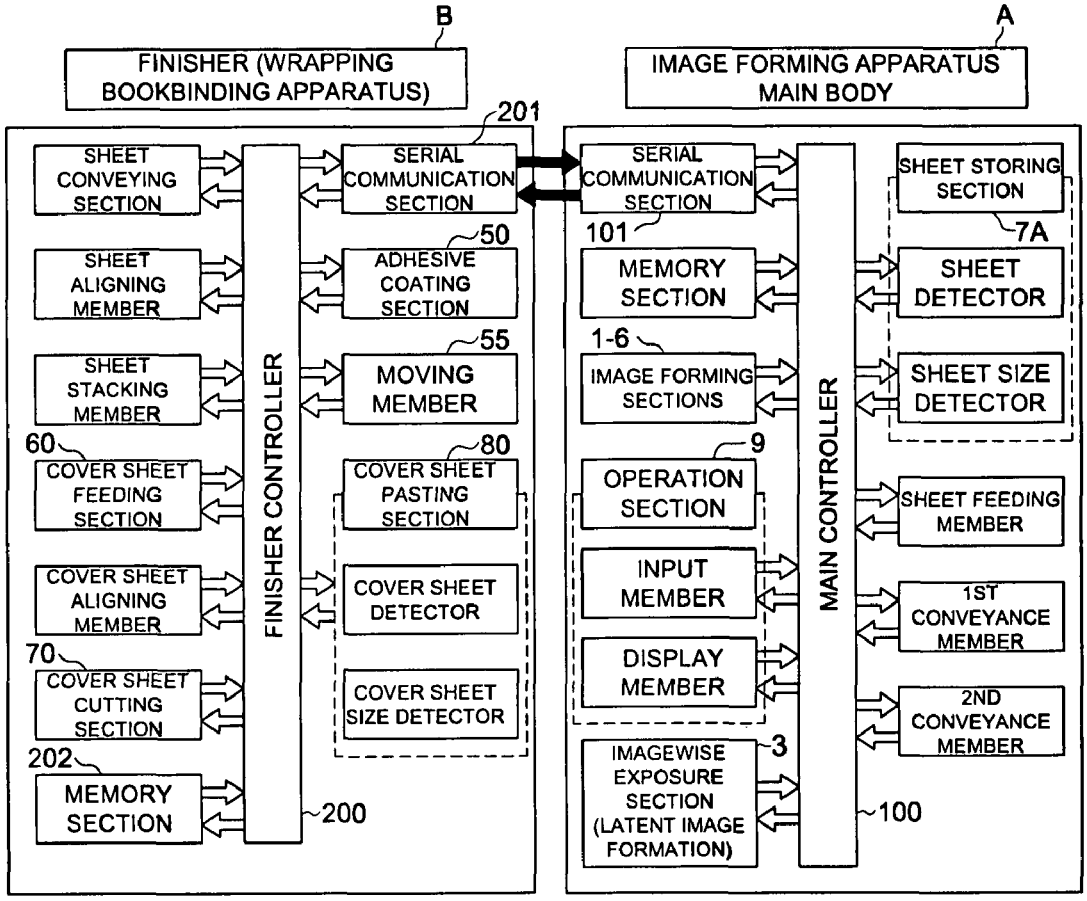
FIG. 11 is a block diagram showing control for the image forming apparatus main body and bookbinding apparatus.

FIG. 11 is a block diagram showing control for the image forming apparatus main body A and bookbinding apparatus B.

The main controller 100 of the image forming apparatus main body A and a finishing controller 200 of the bookbinding apparatus B are connected by serial communication sections 101 and 201.

The main controller 100 controls a sheet detector arranged in a sheet storing section 7A, a sheet size detector for detecting the width and height of the sheet S, a sheet feeding member, a first conveyance member before the transfer process, a second conveyance member after the transfer process, an image forming section, a memory section 202, a comparison section, an operation section 9 composed of an input member and a display member, and a serial communication section 101.

Further, the main controller 100, in accordance with the size of the sheet S, controls so as to form a latent image of a document image and a latent image of an added image by the imagewise exposure unit 3.

The finishing controller 200 controls the sheet conveying section 10, a sheet aligning member, a sheet stacking member, the cover sheet feeding section 60, a cover sheet aligning member, the cover sheet cutting section 70, the adhesive coating section 50, the moving member 55 of the moving section 54 of the adhesive coating section 50, a cover sheet detector of the cover sheet pasting section 80, and a cover sheet size detector for detecting the width and height of the cover sheet K.

Further, the program of executing the finishing process is stored in a ROM not drawn of the memory section 202 of the bookbinding apparatus B, is expanded in the RAM at time of execution, and is executed by the finishing controller 200 of the bookbinding apparatus B.

Further, the bookbinding apparatus B of the present invention is formed as an independent apparatus, and the sheet bundle Sa processed by another image forming apparatus is stacked on the sheet bundle conveying section 40, and then the adhesive coating process and cover sheet pasting process are performed, and a wrapping bookbinding apparatus can be prepared.

In this embodiment, the application to the bookbinding system having the image forming apparatus main body capable of forming a monochromatic color image is explained, though the present invention can be applied to a bookbinding system having an image forming apparatus main body capable of forming a full color image.

Particularly, when using a large amount of toner such as a picture image and forming a document toner image up to the end of a sheet, by use of the embodiment of the present invention, a great effect can be obtained. In this case, when the scanner unit of the image forming apparatus main body reads a document image and the main controller 100 judges that the read document data is the color image data, it can be set automatically not to form an image at the end of the sheet.

Further, when receiving document data from an external device such as a personal computer, if the main controller 100 judges from the received document image data that the document image is a color image, it can be set automatically not to form an image at the end of the sheet.

Further, the picture image forming mode is designated from the operation section 9 or the external device, it can be set automatically not to form an image at the end of the sheet.

Further, this embodiment uses the constitution that the heated adhesive N is coated on the spine of the sheet bundle. However, the present invention is not limited to this constitution and a constitution that the adhesive N is coated on the cover sheet K and immediately after coating, the cover sheet K is pasted on the sheet bundle Sa may be used. However, when the present invention is applied to the constitution that the adhesive N is coated on the spine of the sheet bundle Sa, the effect of the present invention is great.

According to the bookbinding system and bookbinding method, when adhering the cover sheet to the spine of the sheet bundle by a heated adhesive, pasting between the sheets caused at the ends of the sheets is prevented, thus the quality of a booklet bound by pasting is improved.

What is claimed is:

1. A bookbinding system that pastes a cover sheet onto a sheet bundle, the bookbinding system comprising:

(a) an image forming section which forms a toner image based on image data;

(b) a sheet storing section which stacks recording sheets on which toner images have been recorded by the image forming section, aligns the recording sheets thereby forming a sheet bundle;

(c) a heating member which applies heat to an adhesive to melt;

(d) a cover sheet pasting section which pastes a spine of the sheet bundle and a cover sheet with the adhesive melted by the heating member; and (e) a controller which controls the image forming section to shift and form the toner image based on the image data in a direction toward an edge portion opposite to the edge portion of the spine, when pasting the cover sheet onto the sheet bundle with the melted adhesive, whereby the controller controls the image forming section not to record the toner image based on the image data in the vicinity of the edge portion on a side of the spine of each of the recording sheets that constitute the sheet bundle, wherein the controller controls the image forming section to reduce and form the toner image according to a shifting amount of the toner image.

2. The bookbinding system of claim 1, further comprising an adhesive coating section which coats the adhesive melted by the heating member onto the spine of the sheet bundle.

3. The bookbinding system of claim 1, further comprising an image carrier and an imagewise exposure unit which forms a latent image for the toner image on the image carrier.

4. The bookbinding system of claim 1, further comprising a cover sheet bending section which bends the cover sheet that has been pasted to the spine of the sheet bundle, along a side edge of the sheet bundle.

5. The bookbinding system of claim 1, wherein the image forming section is capable of forming a color image, and when the controller judges that the image data is a color image data; the controller controls the image forming section not to record the toner image based on the image data in the vicinity of the edge portion on the side of the spine.

6. The bookbinding system of claim 1, wherein the controller is capable of dealing with a photographic image forming mode, and when the photographic image forming mode is designated, the controller controls the image forming section not to record the toner image based on the image data in the vicinity of the edge portion on the side of the spine.

7. A bookbinding system that pastes a cover sheet onto a sheet bundle, the bookbinding system comprising:

(a) an image forming section which forms a toner image based on image data;

(b) a sheet storing section which stacks recording sheets on which toner images have been recorded by the image forming section, aligns the recording sheets thereby forming a sheet bundle;

(c) a heating member which applies heat to an adhesive to melt;

(d) a cover sheet pasting section which pastes a spine of the sheet bundle and a cover sheet with the adhesive melted by the heating member; and (e) a controller which controls the image forming section to shift and form the toner image based on the image data in a direction toward an edge portion opposite to the edge portion of the spine, when pasting the cover sheet onto the sheet bundle with the melted adhesive, whereby the controller controls the image forming section not to record the toner image based on the image data in the vicinity of the edge portion on a side of the spine of each of the recording sheets that constitute the sheet bundle, wherein when the document toner image is a character image, the controller changes a character setting so as to reduce the number of characters on one line and controls so as to provide a non-image area.

8. The bookbinding system of claim 7, further comprising an adhesive coating section which coats the adhesive melted by the heating member onto the spine of the sheet bundle.

9. The bookbinding system of claim 7, further comprising an image carrier and an imagewise exposure unit which forms a latent image for the toner image on the image carrier.

10. The bookbinding system of claim 7, further comprising a cover sheet bending section which bends the cover sheet that has been pasted to the spine of the sheet bundle, along a side edge of the sheet bundle.

11. The bookbinding system of claim 7, wherein the image forming section is capable of forming a color image, and when the controller judges that the image data is a color image data; the controller controls the image forming section not to record the toner image based on the image data in the vicinity of the edge portion on the side of the spine.

12. The bookbinding system of claim 7, wherein the controller is capable of dealing with a photographic image forming mode, and when the photographic image forming mode is designated, the controller controls the image forming section not to record the toner image based on the image data in the vicinity of the edge portion on the side of the spine.

* * * * *